US006336769B1

(12) United States Patent
Cincis et al.

(10) Patent No.: US 6,336,769 B1
(45) Date of Patent: Jan. 8, 2002

(54) SCREEDING APPARATUS AND COMPONENTS THEREFOR

(76) Inventors: Thomas Cincis, 201 E. 69th St., Apt. #42, New York, NY (US) 10021; James Moshier, 8 Treehaven La., Riverhead, NY (US) 11901

( * ) Notice: Subject to any disclaimer, the term of this patent is extended or adjusted under 35 U.S.C. 154(b) by 0 days.

(21) Appl. No.: 09/306,309

(22) Filed: May 6, 1999

(51) Int. Cl.[7] ..... E01C 19/22
(52) U.S. Cl. ..... 404/118; 404/124
(58) Field of Search ..... 404/101, 102, 404/103, 114, 117, 118, 122, 124, 104, 106, 112

(56) References Cited

U.S. PATENT DOCUMENTS

| | | | | | |
|---|---|---|---|---|---|
| 1,063,972 | A | | 6/1913 | Hollings | |
| 1,294,228 | A | | 2/1919 | Bontoft | |
| 1,363,444 | A | * | 12/1920 | Van Den Heuvel | 404/124 |
| 2,048,071 | A | * | 7/1936 | Jacobson | 404/124 |
| 2,341,316 | A | | 2/1944 | Ederer | |
| 3,311,086 | A | | 3/1967 | Kaier | |
| 3,336,848 | A | * | 8/1967 | Moir | 404/114 |
| 4,386,901 | A | | 6/1983 | Morrison | |
| 4,537,269 | A | * | 8/1985 | Fisher | 180/10 |
| 4,655,633 | A | | 4/1987 | Somero | |
| 4,822,210 | A | * | 4/1989 | Oury et al. | 404/106 |
| 4,930,935 | A | | 6/1990 | Quenzi et al. | |
| 4,964,753 | A | * | 10/1990 | Ciminelli et al. | 404/122 |
| 5,039,249 | A | | 8/1991 | Hansen et al. | |
| 5,051,025 | A | | 9/1991 | Taylor | |
| 5,129,803 | A | * | 7/1992 | Nomura et al. | 404/102 |
| 5,156,487 | A | | 10/1992 | Haid | |
| 5,190,401 | A | | 3/1993 | Wilson | |
| 5,224,793 | A | | 7/1993 | De Pol | |
| 5,228,528 | A | | 7/1993 | Sauve | |
| 5,234,281 | A | | 8/1993 | Somero et al. | |
| 5,312,164 | A | | 5/1994 | Nichols | |
| 5,328,295 | A | | 7/1994 | Allen | |
| 5,716,162 | A | * | 2/1998 | Hodgson et al. | 404/117 |
| 5,788,408 | A | * | 8/1998 | Mitsui et al. | 404/117 |
| 5,879,104 | A | * | 3/1999 | Ulrich | 404/102 |
| 5,983,165 | A | * | 11/1999 | Minnich et al. | 404/115 |
| 5,984,572 | A | * | 11/1999 | Misui | 404/117 |
| 6,022,171 | A | * | 2/2000 | Munoz | 404/124 |

* cited by examiner

*Primary Examiner*—Thomas B. Will
*Assistant Examiner*—Raymond W Addie
(74) *Attorney, Agent, or Firm*—Galgano & Burke

(57) ABSTRACT

Methods of screeding and screeding apparatus which are designed to be driven through poured, uncured concrete. Embodiments of the screeding apparatus are provided with novel wheels which can be moved through concrete both before and after screeding without requiring the re-screeding of the areas through which the wheels have passed.

25 Claims, 8 Drawing Sheets

SCREEDING APPARATUS AND COMPONENTS THEREFOR

The present invention relates to an improved screeding apparatus and novel components particularly suited for use with screeding apparatus.

BACKGROUND

Screeding machines known in the art are used to level large areas of poured, uncured concrete, such as roads or large floors found in warehouses or department stores. These screeding machines are typically very large and heavy. Due to their weight, they are typically restricted to use on the ground floor of most buildings.

The weight of many screeding devices also affects their design in that some screeding machines are supported by wheels which run adjacent to the area being screeded. With such designs, screeding machines can generally work along a predetermined path and are not particularly suited for screeding smaller areas off the predetermined path. Other screeding machines have been designed to be driven through poured concrete while supporting a screed behind the wheels in order to displace excess concrete and to level the concrete surface.

Those skilled in the concrete art will also appreciate that poured concrete is quite often strengthened, for example, by reinforcement bars, commonly known as rebar. The strength of the rebar limits the weight of a screeding machine since the rebar could be damaged by excessive weight.

Since, large multi-story buildings, such as department stores and office buildings, commonly have concrete floors, it would be very desirable to provide a screeding machine which is relatively light and easily maneuverable.

It would also be desirable to provide a screeding apparatus which can pass through poured, uncured concrete in order to maximize the areas that can be screeded.

SUMMARY OF THE INVENTION

One aspect of the present invention comprises a novel screeding apparatus which is designed to be driven through poured, uncured concrete.

According to another aspect of the present invention, a screeding apparatus is provided with novel wheels which can be moved through concrete after screeding and without requiring the re-screeding of the areas through which the wheels have passed.

According to another aspect of the present invention, a screeding apparatus is provided with at least one open frame wheel and at least one vibrator for vibrating at least one wheel as the wheel passes through uncured concrete. According to one preferred embodiment of this invention, the vibrating mechanism is adjustable in order to increase the force and/or frequency of the vibration applied to the wheel. As used herein, the term "open frame" is used to indicate that concrete can flow substantially freely around or through the wheel. For example, according to some of the illustrated wheel embodiments, uncured concrete can flow at least partially in a direction perpendicular to the path of travel of the screeding machine.

These and other advantageous aspects of the present invention will be apparent to those skilled in the art from the following description and accompanying figures.

DETAILED DESCRIPTION

Figure 1:
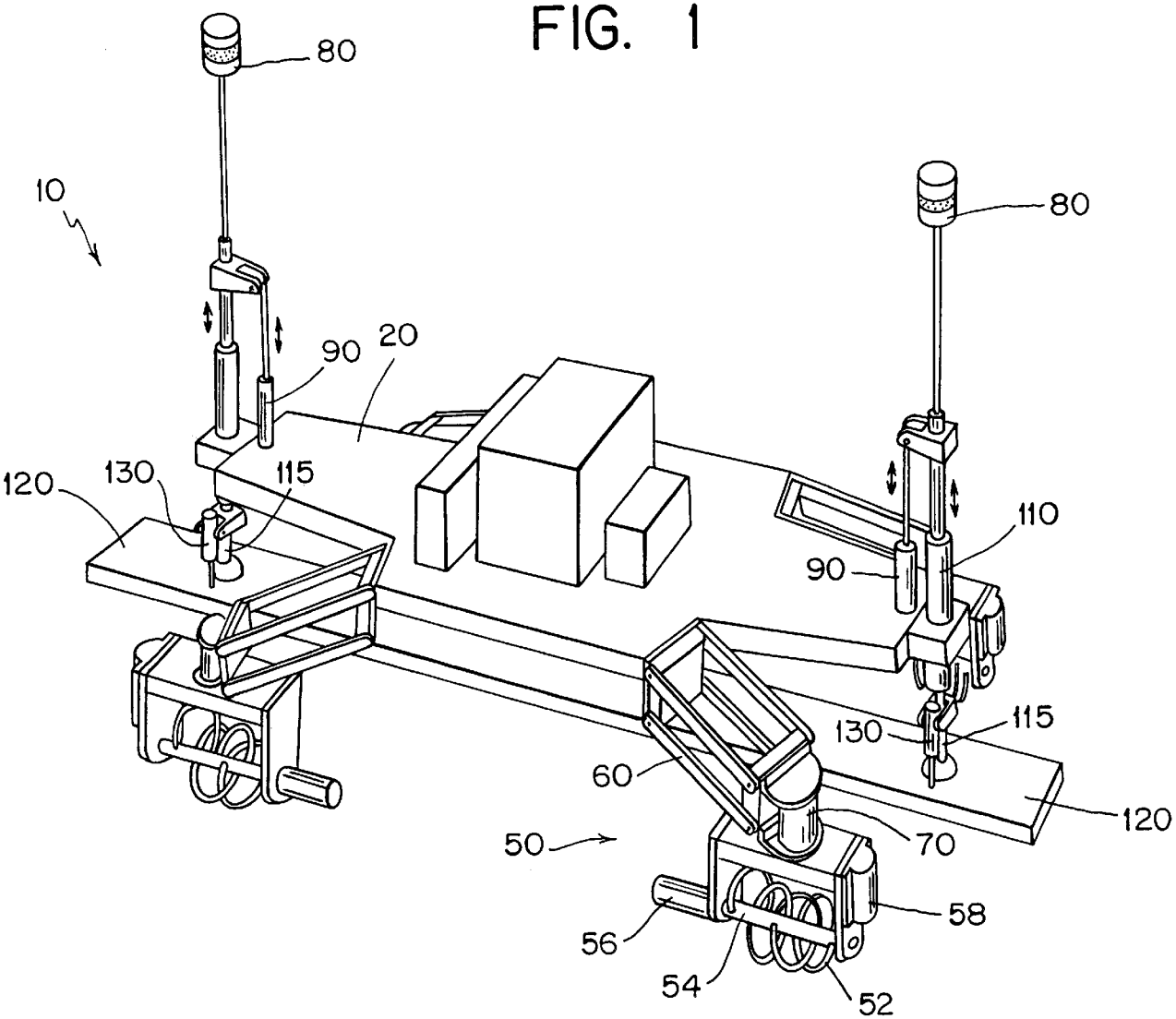
FIG. 1 is a perspective view of a screeding apparatus of one embodiment of the present invention.

One preferred embodiment of the present invention illustrated in FIG. 1 shows a screeding apparatus 10 comprising a frame 20 which is movably supported by four wheel assemblies 50, only two of which are clearly shown in FIG. 1. The illustrated wheels are designed to pass directly through uncured concrete either before or after that concrete section has been screeded. The illustrated wheel assemblies 50 are attached to the frame 20 by a pivotal, four-bar linkage 60. Those skilled in the art will appreciate that as screeding apparatus 10 is propelled through uncured concrete, the wheels will ride up and down over various objects, e.g., reinforcement bars, stones, etc. Therefore, it is desirable to provide some degree of resilience between the wheel assemblies 50 and the frame 20 with a four-bar linkage or some other controlled pivotal attachment.

The preferred illustrated wheel assemblies comprise wheel segments 52 connected to an axle 54 which is connected to a hydraulic drive 56. Each wheel assembly is also advantageously provided with a vibration assembly 58 which vibrates the wheel segments 52 as they pass through the uncured concrete. The vibration caused by vibration assembly 58 is preferably adjustable with suitable controls (not shown). In this manner, the frequency, force and amplitude of the vibration imparted to the wheel assembly can be adjusted in order to provide sufficient vibration such that wheel assemblies passing through screeded concrete will urge the concrete to a sufficiently smooth finish so that further screeding is unnecessary. It is also desirable to avoid too much vibration in some situations. For example, those skilled in the concrete art will appreciate that concrete can be vibrated too much, the stones will settle down to the bottom of the concrete and lose part of their effectiveness.

According to this illustrated embodiment, the actual screeding of the concrete surface is performed utilizing a laser leveling system, such as that provided by Topcon Laser Systems, Inc. 5758 W. Las Positas Blvd., Pleasanton, Calif. FIG. 1 illustrates a pair of detectors 80 for the laser leveling system. The detectors are linked to a pneumatically operated vertical control system comprising a hydraulic piston 90 and a linear bearing assembly 110 which cooperate to provide vertical adjustment to the screed 120 as the screeding apparatus 10 is propelled through the uncured concrete. Linear bearing assembly 110 advantageously bears some of the load of the vertical support bar 115 while permitting the hydraulic piston 90 to provide the needed vertical adjustments. In addition to vertical adjustment, the angle of the screed 120 is also advantageously adjustable utilizing hydraulic controls 130 which are pivotally connected to vertical support bars 115.

Suitable controls are provided to operate and coordinate each of the various operations of screeding apparatus 10. For example, one or more potentiometers can be used to control the speed and vibration of the screed as it passes through the uncured concrete. As the particular types of controls can be selected by one skilled in the art, these controls are not explained in greater detail herein.

Figure 2:
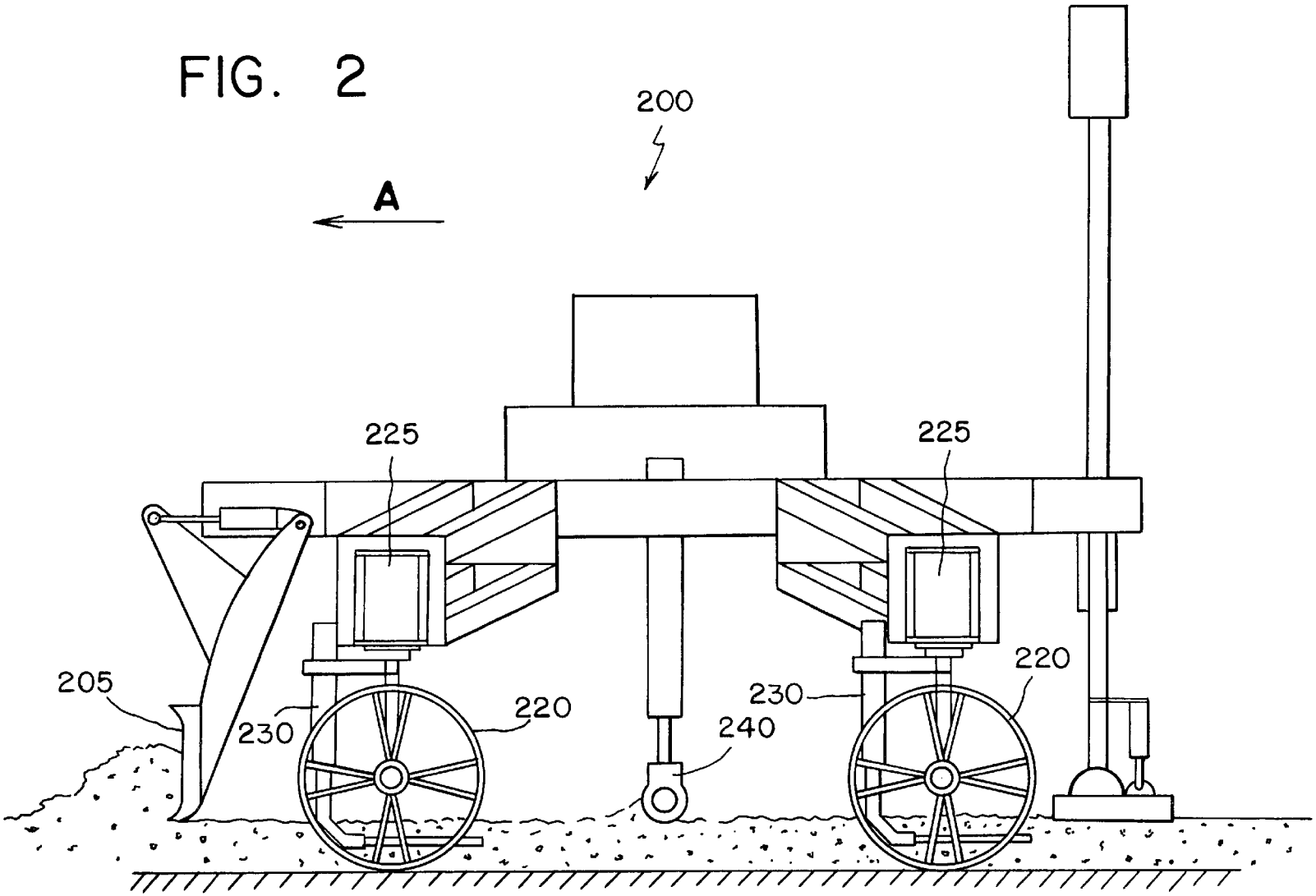
FIG. 2 is a side view of an alternative embodiment of the present invention.
Figure 3:
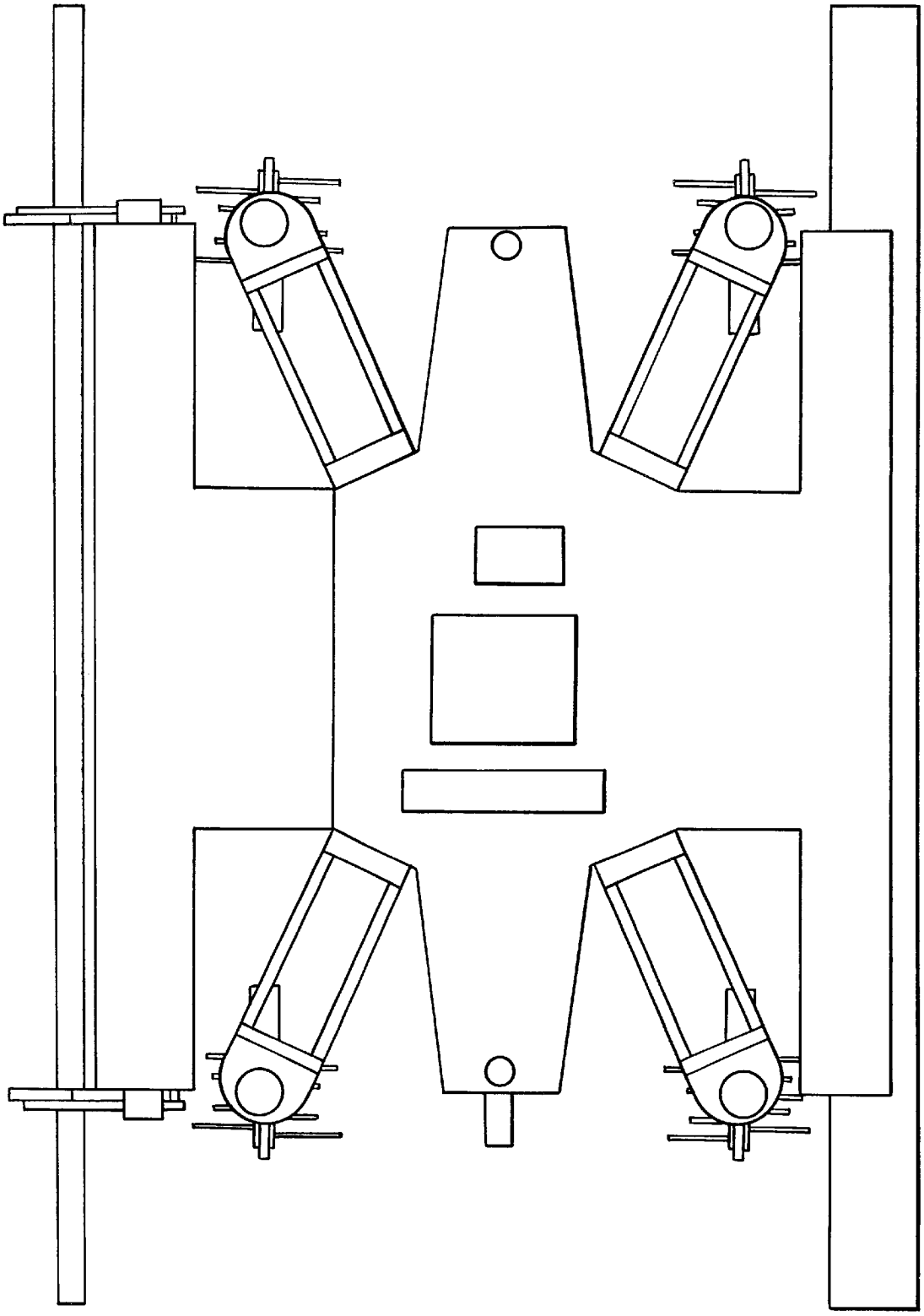
FIG. 3 is a top view of the embodiment illustrated in FIG. 2.

An alternative embodiment of the present invention is illustrated in FIGS. 2 and 3. In this embodiment, a screeding apparatus 200 is designed to be self-propelled through uncured concrete in the direction indicated by arrow A. Located at the forward end of screeding apparatus 200 is a plow blade 205 which is height adjustable in order to remove large quantities of excess concrete. Following adjustable plow blade 205 is a set of wheel assemblies 220 which are vibrated by vibration mechanisms 225. Additional concrete vibrators 230 are provided to impart desired vibrations to the uncured concrete. Following the forward wheel assemblies is a rotatable auger 240 which is preferable designed to direct finer quantities of excess concrete either in a single desired direction or out to both sides of the screeding apparatus 200. Following the rotatable auger is another set of wheel assemblies, preferably having vibration mechanisms similar to the forward wheel assemblies. Following the rear wheel assemblies is a laser leveling apparatus, which can be of the type described in reference to FIG. 1. While a laser leveling system is preferred, it is within the scope of the present invention to use other leveling systems such as sonar, string line guide, mathematical adjustment and manual adjustment.

Suitable controls are provided to operate and coordinate each of the various operations of screeding apparatus 200 including, for example, the speed of rotation of the wheel assemblies, the direction of the wheel assemblies, the frequency and force applied by the different vibrating mechanisms, the heights and pitches of the plow augers and levelers. These controls are most preferably remote controls.

Figure 13:
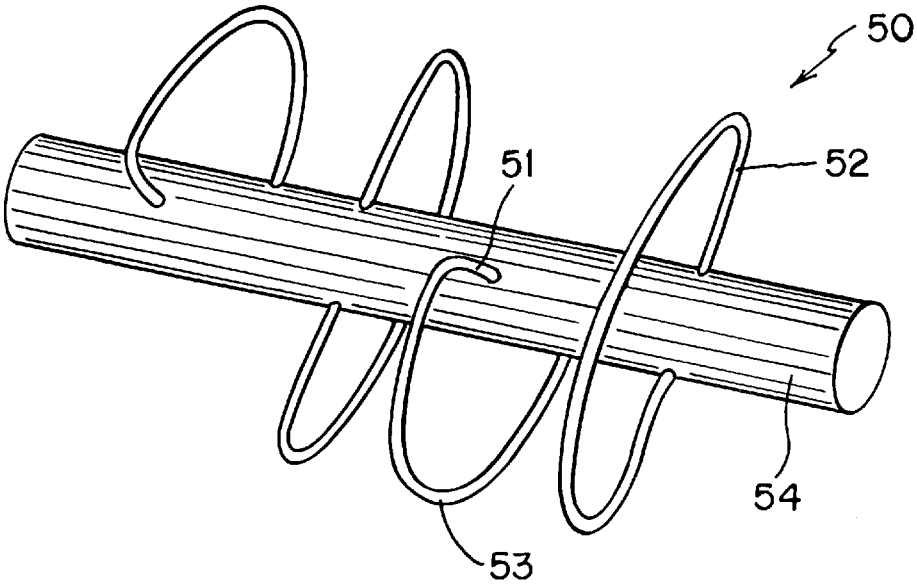

FIG. 13 shows greater detail of a wheel assembly 50 wherein wheel segments 52 are connected to axle 54. In this illustrated embodiment, the wheel assembly comprises four wheel segments. Each wheel segment comprises a spoke portion 51 and a support portion 53 comprising an arcuate surface. Each of the illustrated support portions 53 of this illustrated embodiment preferably pass through an angle of about 70–130° degrees. In order to provide a relatively smooth ride, adjacent, spaced wheel segments are positioned with circumferentially overlapping portions in the same manner as wheel assemblies 220 illustrated in FIG. 2.

Other wheel designs may be utilized without departing from the scope of the present invention. For example, wheels similar to wheel assemblies 50 may be utilized using different numbers of wheel segments which pass through greater or smaller circumferential arcs.

The present invention offers a number of different designs for supporting a screeding apparatus. From the present description, those skilled in the art will appreciate that a particular support can be selected for a particular application. Elevated decks and subgrades can include sand, gravel, metal decks, wood decks, plastic barriers and different reinforcement materials including rebar, wire mesh and/or fiber mesh. Therefore, the particular support utilized will take the particular decking and/or subgrade into account.

Figure 4:
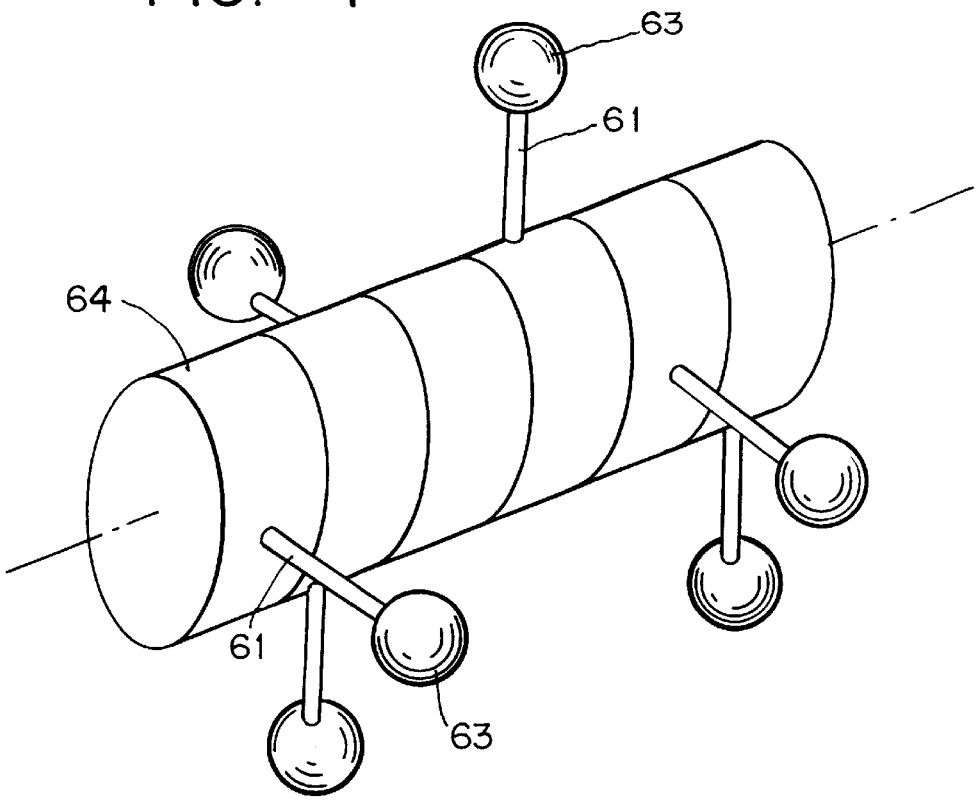
FIGS. 4–13 illustrate rotatable supports for use with various embodiments of the present invention.

FIG. 4 illustrates an alternative drive mechanism wherein a plurality of radially-offset spherical supports 63 are supported in space relation from a central hub by spoke portion 61. Each of the spoke portion 61 are connected to a cylindrical axle 64. In order to facilitate repair and/or replacement of the spherical support 63, in the event of damage or routine maintenance and replacement, the axle 64 is also formed in a plurality of segments which can easily be removed and replaced.

Figure 5:
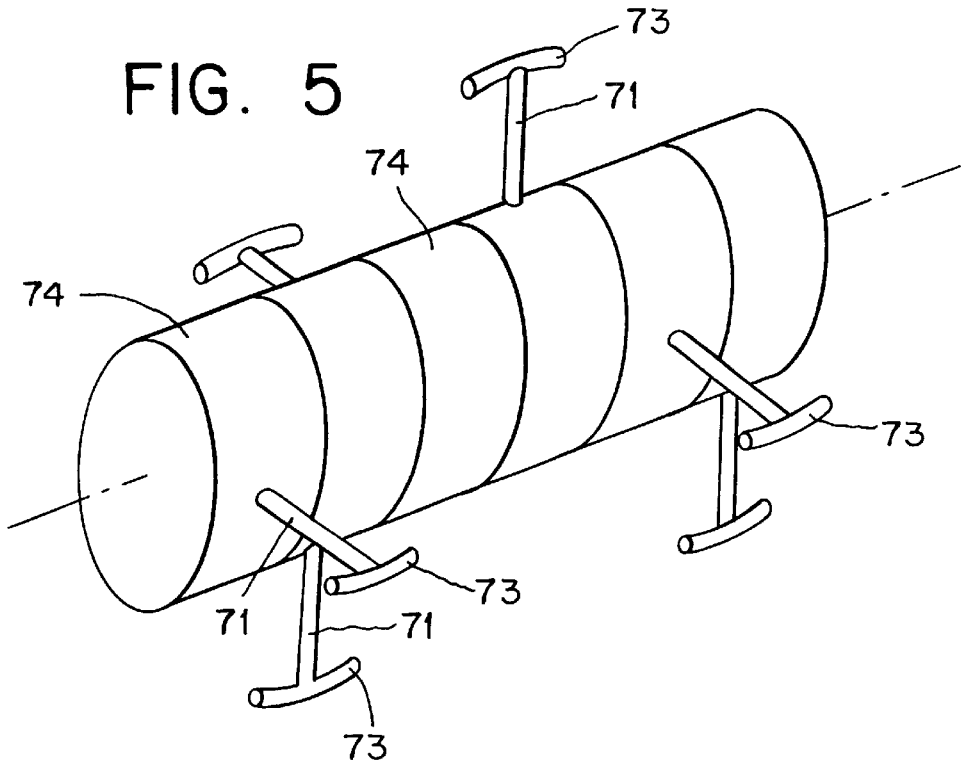

FIG. 5 illustrates an alternative arrangement comprising a plurality of radially-offset generally arcuate support 73 positioned at the ends of spoke portion 71 each of which are connected to a axle segment 74.

Figure 6:
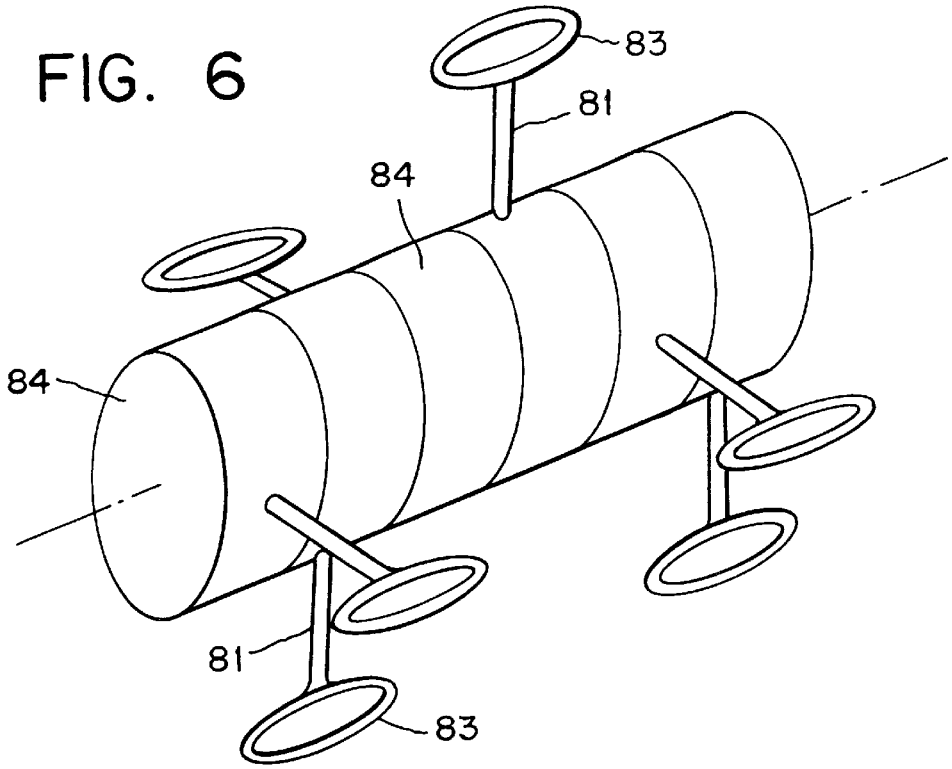

In an alternative embodiment illustrated in FIG. 6, a plurality of closed loop supports 83 are connected via spoke portions 81 to axle segments 84.

Figure 7:
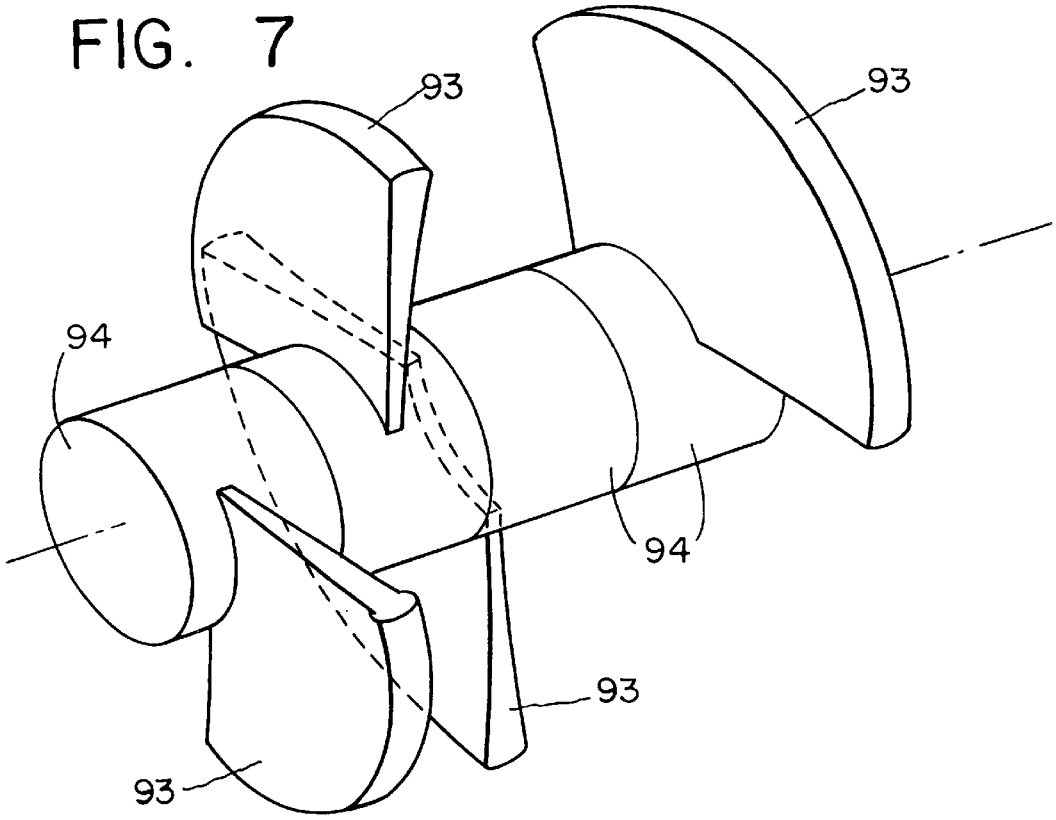

FIG. 7 illustrates an alternative embodiment wherein closed segments 93 are attached to axle segments. As with the embodiment illustrated in FIGS. 2 and 3, the generally arcuate, closed supports 93 are preferably designed to overlap when viewed along the longitudinal axis of axle portions 94. The support sections 93 are most preferably formed with rounded outer faces in order to provide a smooth motion for the screeding device through uncured concrete. The supports 93 can either be solid or hollow.

Figure 8:
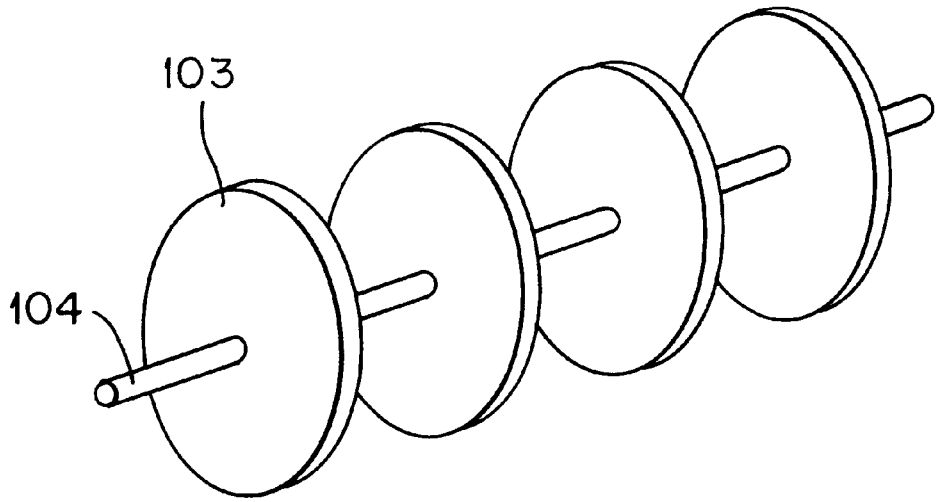
Figure 9:
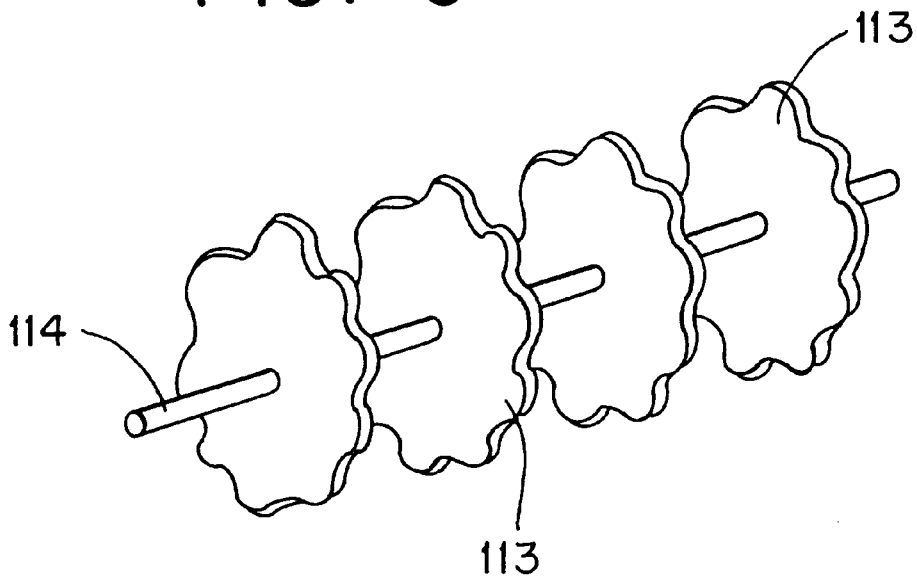

FIGS. 8 and 9 illustrate further embodiments which comprise disks 103 mounted on axles 104 and irregular disks 113 mounted on axle 114, respectively.

Figure 10:
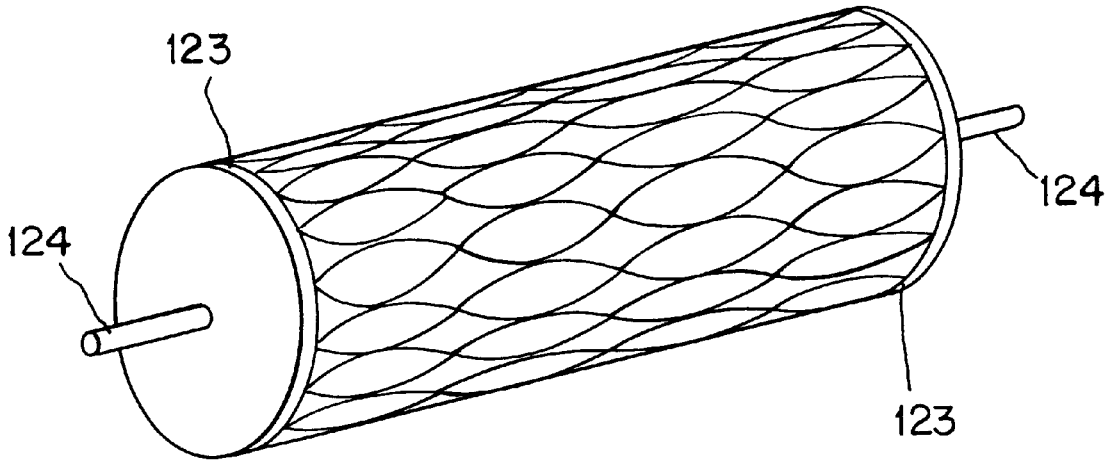

The embodiment of FIG. 10 comprises an open wire structure 122 supported by rounded disks 123 and mounted on a central axle 124. The spacing of the wire in this embodiment is most preferably designed to permit the wire structure to be rotated out of the uncured concrete while leaving the concrete sufficiently smooth to avoid the need for additional screeding.

Figure 11:
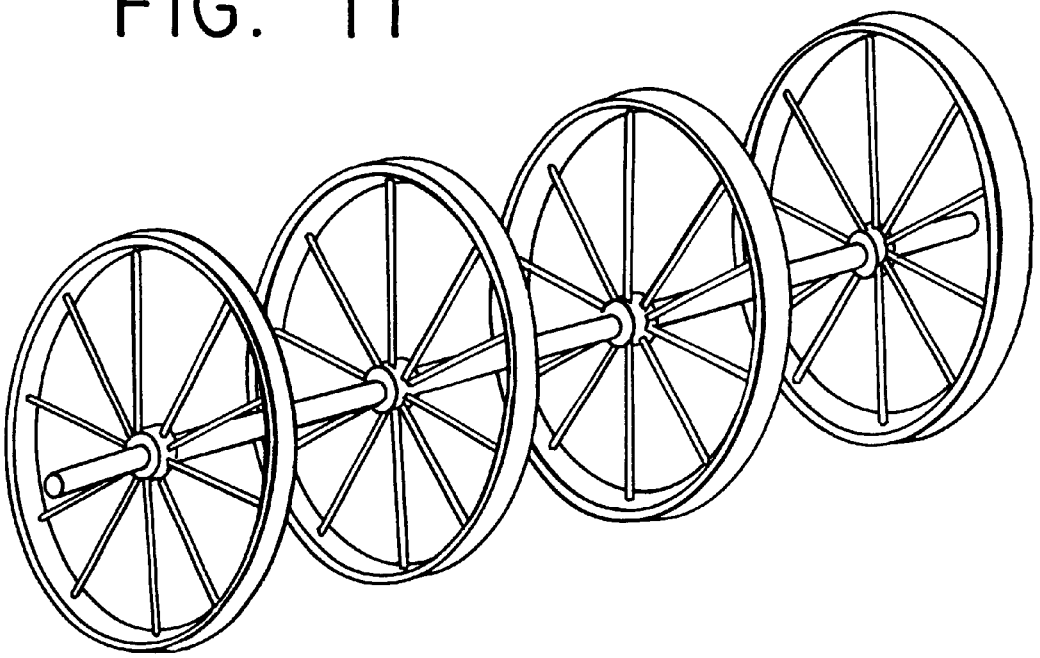
Figure 12:
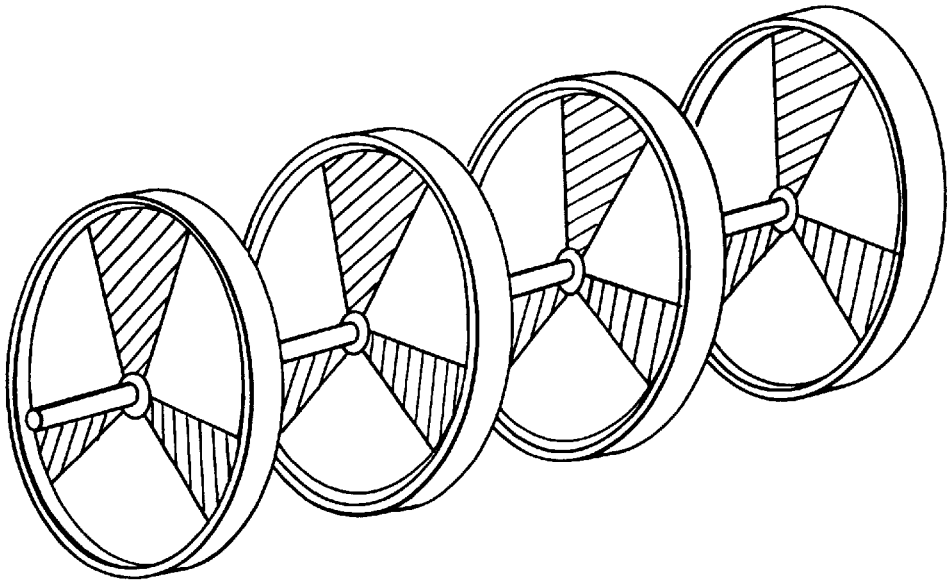

FIGS. 11 and 12 illustrate further embodiments of supports of the present invention wherein a plurality of spaced wheels are mounted on axles by spaced spokes or supports.

Another aspect of the present invention comprises method of leveling uncured concrete comprising the steps of providing a screeding apparatus comprising a plurality of supports which pass through the uncured concrete and a leveling mechanism; passing said screeding apparatus through said uncured concrete such that at least one of said supports passes through a section of concrete which has already been leveled by said leveling mechanism.

What is claimed is:

1. A screeding apparatus for leveling uncured concrete, said apparatus comprising:

a frame;

a plurality of selectively rotatable wheels connected to said frame, at least one of said wheels comprising a plurality of circumferentially-overlapping segments, each of said segments comprising an outer arcuate surface, wherein the sum of said arcuate surfaces extend substantially continuously through at least 360° and means for supporting said arcuate surfaces in horizontally spaced relation; and an adjustable screed supported by said frame.

2. A screeding apparatus according to claim 1 wherein said screeding apparatus comprises at least one forward wheel, rearward wheel and wherein said screed is disposed between said forward wheel and said rearward wheel.

3. A screeding apparatus according to claim 1 wherein said wheels are pivotally connected to said frame.

4. A screeding apparatus according to claim 1 further comprising means for vibrating said wheels.

5. A screeding apparatus according to claim 4 wherein said vibrating means is adjustable.

6. A screeding apparatus according to claim 5 wherein the frequency of said vibrating means is adjustable.

7. A screeding apparatus according to claim 5 wherein the force imparted by said vibrating means is adjustable.

8. A screeding apparatus according to claim 4 further comprising means for vibrating said screed.

9. A screeding apparatus according to claim 8 wherein said screed vibrating means is adjustable.

10. A screeding apparatus according to claim 9 wherein the frequency of said screed vibrating means is adjustable.

11. A screeding apparatus according to claim 9 wherein the force imparted by said screed vibrating means is adjustable.

12. A screeding apparatus according to claim 1 further comprising means for vibrating said screed.

13. A screeding apparatus according to claim 1 further comprising means for rotating at least one of said wheels.

14. A screeding apparatus according to claim 13 wherein said rotating means comprises a motor operatively connected to said wheel.

15. A screeding apparatus according to claim 13 wherein said rotating means comprises a pneumatic drive mechanism.

16. A screeding apparatus according to claim 1 wherein said frame is generally rectangular and said wheels are generally positioned at the corners of the rectangular frame.

17. A screeding apparatus according to claim 1 wherein said screed is vertically adjustable relative to said frame.

18. A screeding apparatus according to claim 1 wherein said screed is angularly adjustable.

19. A screeding apparatus according to claim 1 further comprising a laser operated vertical control mechanism.

20. A screeding apparatus according to claim 1 comprising at least three wheels.

21. A screeding apparatus according to claim 1 comprising at least four wheels.

22. A screeding apparatus according to claim 1 further comprising a plow.

23. A screeding apparatus according to claim 22 further comprising an auger.

24. A screeding apparatus according to claim 1 further comprising an auger.

25. A screeding apparatus according to claim 1 comprising at least three wheels, a forwardly disposed plow, and an auger disposed rearwardly of said plow and forwardly of said screed.

* * * * *